US006672360B1

(12) United States Patent
Kraeutler

(10) Patent No.: US 6,672,360 B1
(45) Date of Patent: Jan. 6, 2004

(54) MATERIAL HANDLING GATE

(75) Inventor: Bernard Kraeutler, Dunieres (FR)

(73) Assignee: Nergeco, Dunieres (FR)

( * ) Notice: Subject to any disclaimer, the term of this patent is extended or adjusted under 35 U.S.C. 154(b) by 0 days.

(21) Appl. No.: 09/720,035

(22) PCT Filed: Jun. 17, 1999

(86) PCT No.: PCT/FR99/01451

§ 371 (c)(1),
(2), (4) Date: Apr. 23, 2001

(87) PCT Pub. No.: WO99/67498

PCT Pub. Date: Dec. 29, 1999

(30) Foreign Application Priority Data

Jun. 24, 1998 (FR) ..... 98 08018

(51) Int. Cl.[7] ..... E06B 3/48

(52) U.S. Cl. ..... 160/84.06; 160/267.1; 16/90 R

(58) Field of Search ..... 160/84.01, 84.06, 160/264, 267.1, 285, 287, 277, 268.1, 270, 271; 16/87.4 R, 91, 93 R, 95 R, 96 R

(56) References Cited

U.S. PATENT DOCUMENTS 2,065,813 A * 12/1936 Lang
3,878,583 A * 4/1975 Smart
4,345,635 A * 8/1982 Solomon
5,307,859 A 5/1994 Kraeutler
5,632,317 A * 5/1997 Krupke et al. ..... 160/265
6,148,897 A * 11/2000 Horner et al. ..... 160/271

FOREIGN PATENT DOCUMENTS

| | | | |
|---|---|---|---|
| DE | 74 11 596 | 4/1974 | |
| DE | 74 12 450 | 4/1974 | |
| DE | 41 04 213 | 8/1991 | |
| DE | 295 13 279 | 10/1995 | |
| EP | 480 540 | 4/1992 | |
| EP | 717 807 | 12/1997 | |
| JP | 6193365 | * 7/1994 | ..... 160/84.1 |

* cited by examiner

*Primary Examiner*—Blair M. Johnson
(74) *Attorney, Agent, or Firm*—Sughrue Mion, PLLC

(57) ABSTRACT

An upright for a goods-handling door, said upright including a slideway (1) and being formed in one piece by extrusion or in two mutually snap-fastenable pieces. The upright includes a plane surface (14F) serving to be placed against a wall, so as to position the door and the slideway appropriately, so that space is left on either side of the door for receiving the curtain if it comes out of the slideway.

12 Claims, 5 Drawing Sheets

MATERIAL HANDLING GATE

The invention relates to goods-handling doors.

The term "goods-handling doors" is used to designate doors installed in factories, warehouses, sheds, stores, etc. to make communication possible between different volumes or with the outside, and to provide temperature and noise insulation between said volumes or relative to the outside.

In general, such a door must be capable of being opened and closed rapidly, by opening or closing an opening formed in a wall, in order to enable people and vehicles to pass through, and in order to limit the time for which said insulation is no longer provided.

One type of such a door comprises a panel mounted to move up and down between two uprights. It is common for the door to comprise a curtain that can be rolled or folded up at the top of the opening (or on either one of the sides of the opening), it being possible generally for the curtain to be a flexible sheet or to be made up of hinged panels. A rotary shaft is disposed, for example above the opening, to roll up the curtain, or else straps are provided to raise the curtain. The curtain is generally reinforced by at least one rigid bar whose ends slide with the edges of the curtain in vertical (or optionally horizontal) slideways disposed in the uprights, or formed by said uprights.

The slideways serve to guide the edges of the curtain and to provide the best possible sealing.

An object of the present invention is to provide an upright or a slideway for that type of door. Known slideways are made of folded sheet metal and by welding, or they may be made by extrusion (see, for example, German Patent Applications Nos. 74 11596, 74 12450, and 295 13 279). It is usually necessary to mount the slideways on carrier uprights, to fix the uprights or the slideways to brackets or to a crosspiece at their tops, to weld on a stage for receiving the motor members, and to fix the bottoms to bases. The bare parts must be cleaned and painted.

An object of the invention is to provide an upright carrying a slideway, or a multi-function slideway, that can be made more simply, more accurately, more quickly, and less expensively, while also offering greater rigidity and robustness. An object of the invention is also to provide a door constructed using such uprights.

FIG. 13 is a perspective view of a goods-handling door of the fold-up curtain type that is conventional and quite general. It is placed against a wall 10 to close and to open an opening formed in the wall between two inside volumes, or between an inside volume and an outside volume. It includes a curtain 61 mounted to move between uprights 62 and 63 that contain slideways, in which the edges of the curtain slide, as do the ends of stiffener bars 64. The bars 64 are received in horizontal sheaths formed in the curtain. The uprights 62 and 63 are interconnected at their tops by a horizontal crosspiece 65. The uprights and/or the crosspiece are fixed to the wall by any suitable means. The horizontal top edge of the curtain is fixed suitably to the inside of the crosspiece. The curtain is moved by vertical straps 66 whose bottom ends are fixed to a bottom stiffener bar 67 which is itself fixed along the bottom horizontal edge of the curtain which, in the closed position, rests on the ground, or lies in the vicinity thereof.

To raise the curtain, the straps can be wound up on a shaft disposed in the top crosspiece 65. The shaft is controlled by an electric motor, and an electrical installation serves to enable the curtain to be moved under automatic control. To drive the various bars, the straps pas through loops 68 fixed to the bars 64, windows being provided in the sheaths receiving the bars 64 so as to enable the loops to pass through. Well-known devices may be provided to cause the door to be opened automatically when a vehicle approaches.

Gebrauchsmuster No. 7 411 596also discloses an upright including a slideway, the upright being made up of two elements that can made by extrusion. That upright is formed with grooves and ribs for various fixing purposes: fixing together the two elements of the upright, and fixing slide strips for protecting the slideway from wear and facilitating sliding.

The present invention provides an upright for a goods-handling door that comprises a panel mounted to move up and down between two uprights, said upright including a slideway for guiding one edge of the panel, the slideway being made up of two walls, each wall having an outside face and an inside face, the two inside faces defining a slide volume between them that is centered on a slide plane, said upright being characterized in that it includes at least one surface organized to be applied against a wall so that the slide plane is parallel to said wall, and so that said wall is situated at a sufficient distance from the adjacent outside face of the slideway, and the volume situated between the wall and said outside face being unobstructed so as to be capable of receiving the edge of the panel when said panel is disengaged from the slideway.

In an advantageous embodiment of the invention, the upright has a closed section defining an internal volume that can receive accessories, and various members such as, for example, electric wires, controls, ducts, cables, and a counterweight.

According to a characteristic of the invention, the upright is obtained in a single operation. Preferably, said operation enables the upright to be made completely and finally to its installation and operating dimensions: extrusion, pultrusion, drawing, rolling, thermoforming, continuous forming, or stamping.

In an embodiment of the invention, the upright is obtained by assembling together or snap-fastening at least two pieces, at least one of which is obtained in a single operation.

According to a characteristic of the invention, at least one of the pieces is obtained by extrusion, pultrusion, drawing, rolling, thermoforming, continuous forming, or stamping.

The invention also provides a door including at least one such upright, and preferably two symmetrical uprights. Advantageously, for each upright, such a door includes a base for receiving the upright directly, which base bears against the floor.

In an advantageous application, the panel of the door comprises at least one curtain made up of at least two juxtaposed flexible sheets interconnected vertically via a stiffener bar, at least one edge of each sheet forming a horizontal portion of extra thickness and the bar being provided with two channels which open to the outside via a slot whose edges turn inwards to retain the thickened edges of the sheets.

When the panel is made up of one or two flexible curtains, the wall of the slideway may have a thickness such that the outside face of said wall lies substantially in the plane of a curtain.

In an embodiment, the panel is made up of at least one flexible curtain reinforced by at least one horizontal bar whose end is provided with a guide shoe including a guide peg organized to penetrate into and slide in the slideway, and at least one slide tab disposed to slide against the outside surface of a wall of the slideway. The guide peg may be provided with a roller.

Other characteristics and advantages of the invention appear from the following description given by way of non-limiting example and with reference to the accompanying drawings, and making it possible to understand well how the invention may be implemented.

Figures 1, 2, 3, 4:
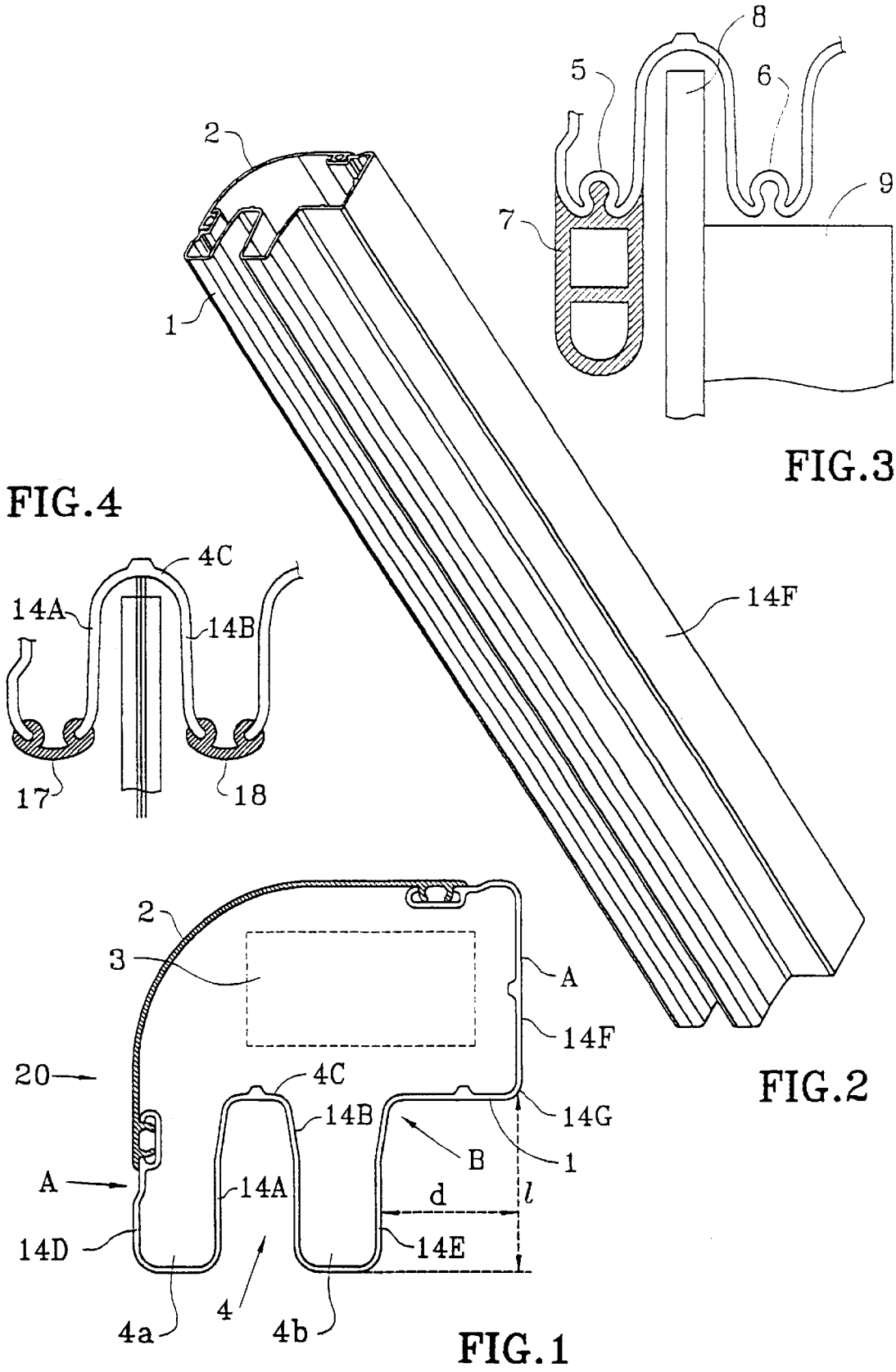
FIG. 1 is a section view of an embodiment of a multi-function upright of the present invention.
FIG. 2 is a perspective view of an element as shown in FIG. 1.
FIG. 3 is a fragmentary section view of a variant.
FIG. 4 is fragmentary section view of another variant.
Figure 7:
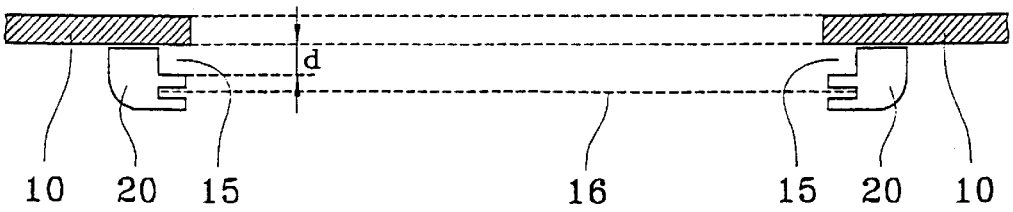
FIG. 7 is a section view on a horizontal plane, showing two uprights as applied against a wall on either edge of an opening.

The slideway 20 shown in FIGS. 1 and 2 is made up, in this example, of two extruded pieces 1 and 2 provided with ribs enabling them to be assembled together by snap-fastening. Piece 1 forms a rigid upright by means of its shape comprising curves and folds. A portion of the upright, between the zones referenced A and B, has a horizontal section in the shape of a W whose angles are rounded, or in the shape of two juxtaposed Us whose adjacent branches are interconnected at their tops by a web 4C forming the back of the slideway, the two Us being spaced apart by the width required for guiding the edge of the curtain. Each of the two Us making up the W constitutes a wall 4A, 4B of the slideway 4. The walls have inside faces 14A and 14B and outside faces 14D and 14E. The slideway may have an open back or a closed back. In this example, the back 4C of the slideway is closed. The inside faces 14A and 14B are substantially uniformly spaced apart, and they delimit a slide volume for slidably receiving the edge of the moving panel of the door. This slide volume defines a slide plane which substantially coincides with the plane 16 of the panel of the door (FIG. 7) when said panel is lowered. In the present example, the walls of the slideway are of non-negligible thickness and they are hollow. The outside faces 14D and 14E of the slideway define slide planes that are useful to certain elements of the panel, e.g. ends of reinforcing bars of the panel, or guide elements. The importance of this configuration is explained below. Piece 2 forms a cover. Advantageously, in the present invention, an empty volume is provided between the upright and the cover, which volume is large enough to enable a counterweight 3 to move in it. When they are made by extrusion, the shaped-section members can be produced in long lengths and cut up at will. They may be made of a lightweight alloy, of aluminum, or of a plastics material. It is thus possible to obtain pieces that are light in weight, strong, insensitive to corrosion, and that do not need to be treated or painted, which is economical for manufacture and for maintenance. However, without going beyond the invention, the uprights may also be made by other methods, such as pultrusion, drawing, rolling, thermoforming, continuous forming, or stamping. It is advantageous to use a method that makes it possible to manufacture the upright in a single operation, or, when it is formed of two pieces, to manufacture at least one of the pieces in a single operation.

In the example shown in FIGS. 1 and 2, the upright is formed with a plane surface 14F parallel to the plane of the moving panel of the door. This plane surface 14F serves to be placed against the wall, on the edge of the opening of the opening that the door serves to close and to open. Said surface is placed at a distance d from the outside surface 14E of the adjacent slideway wall, and the central edge 14G of said surface is situated at a distance from the opening of the slideway that is far enough away to provide a volume 15 between the two surfaces 14E and 14F that makes it possible to receive the edge of the panel when said edge is disengaged from the slideway (see FIG. 7).

Figure 5:
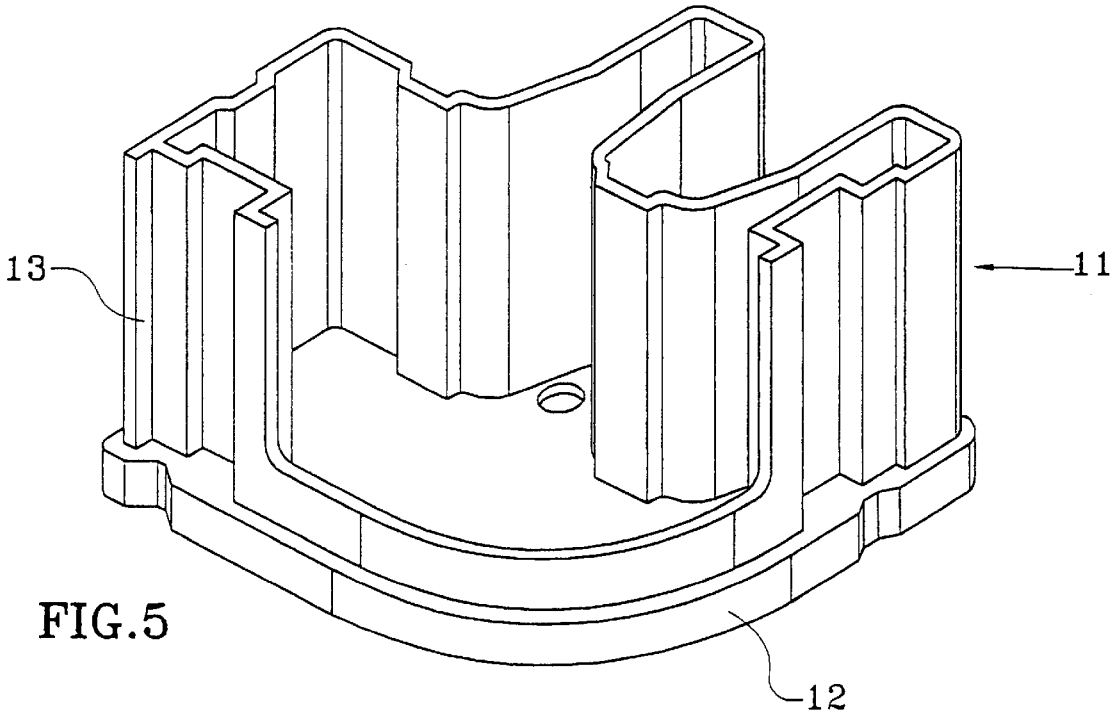
FIG. 5 is a perspective view of a base for an upright of the present invention.

The slideway is cut to the desired length and stood up on a base that is advantageously molded and that may be of the type shown at 11 in FIG. 5. This base comprises a soleplate 12 and a vertical shaped-section member 13 suitable for externally receiving the slideway 1, 2. No hole needs to be formed, nor does any welding need to be done: time is thus saved while also avoiding errors. No painting needs to be done, either during manufacture, or during maintenance. Approximate dimensions due to welding and which frequently give rise to re-adjustment, re-drilling, etc. are avoided.

In a variant embodiment of the invention, a groove may be provided in one and/or the other portion of the slideway, enabling an accessory to be fixed therein, whether said accessory is a shaped-section member or otherwise. In the fragmentary view of FIG. 3, two grooves 5 and 6 are provided. When the panel is formed of a curtain which folds up concertina-like at the top, it is advantageous to provide one side of the slideway with a wall that pushes back the folds of the curtain towards the other side. FIG. 3 shows an extruded piece 7 that can be snap-fastened into the groove 5 formed in an outside edge of the slideway, a bar 8 of the curtain, and the folds 9 that accumulate on the side opposite from the extruded piece. The slideway of the invention can thus be used for a roll-up door in which the curtain rolls up onto the rolling shaft, or for a fold-up or "concertina" door.

It is possible to provide grooves at various places for fixing to the slideway any accessory such as a control cabinet, a counterweight release pull, etc. By way of example, a sealing strip may be received in such a groove, the sealing strip then being disposed so that it comes into abutment against the curtain in the lowered position, so as to provide sealing for it.

FIG. 4 is a fragmentary section view showing an application of the slideway of the invention to a safety system. The slideway cavity 4 constituted by its sides 14A, 14B and by its back 4C, is cut off vertically, and, after being trimmed, it is put back in place by means of flexible fasteners 17, 18. The cavity thus acquires some elastic mobility around a central position. With suitable electrical contacts, it is possible to detect a force exerted on the slideway by the curtain, and thus to detect a force exerted on the curtain. It is then possible to transmit an alarm signal and to trigger a command, e.g. to raise the curtain, to stop lowering it and to raise it again, or to sound a warning siren, etc.

Figure 8:
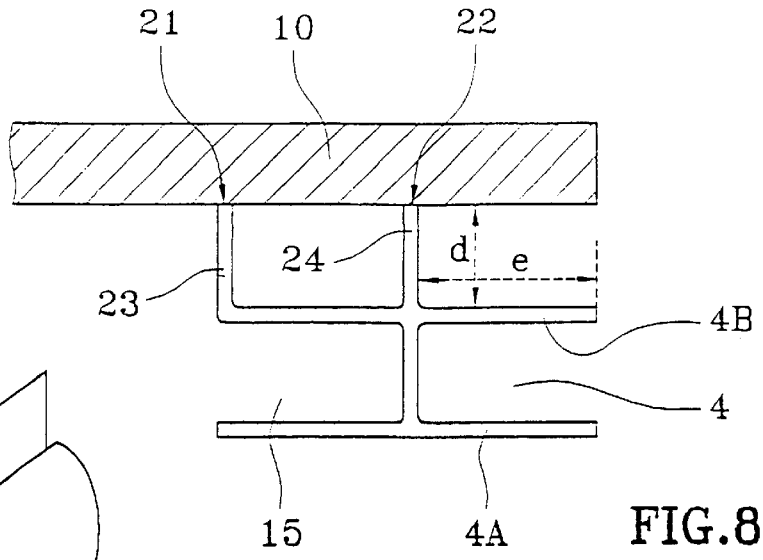
FIG. 8 is a section view on a horizontal plane showing yet another embodiment of the invention.

The shape of the walls of the slideway, with the two faces 14A and 14D, or 14B and 14E of the same wall being spaced apart serves firstly to impart rigidity both to the walls of the slideway and also to the upright as a whole. The wall of a slideway can also be solid and thin as shown in FIG. 8, if the dimensions of the door make it possible for that to be accommodated. The uprights shown in FIGS. 6 and 8 can also receive a counterweight in the volume 15 behind the slideway, and said volume may optionally be closed off by a cover. Each of the uprights in FIGS. 1 and 6 has a plane surface 14F organized to be applied against the wall, on the edge of the opening, in order to position the slideway 4 so as to leave a volume 51 empty to receive the curtain, when said curtain is out of the slideway, on the wall side. The upright shown in section in FIG. 8 does not have such a plane surface. For this upright, the positioning is determined by the edges 21, 22 of the two longitudinal flanges 23 and 24 that are applied against the wall 10.

Figure 6:
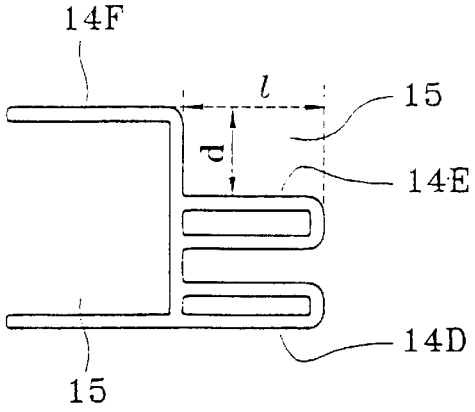
FIG. 6 is a section view on a horizontal plane, showing another embodiment of an upright of the invention.

As can be seen both in FIG. 1 and in FIGS. 6 and 8, the walls of the slideway project from the body of the upright. This leaves the outside faces 14D and 14E of the walls of the slideway unobstructed. In all of the embodiments, the outside face 14E of the slideway must remain unobstructed over a distance corresponding to at least the depth of the slideway in order to define the volume 15 for receiving the curtain when it is disengaged from the slideway, on the side closer to the wall. Similarly, the outside face 14D on the side further from wall must also remain unobstructed in order enable the edge of the curtain to be received when it is disengaged on the side further from the wall.

When at least one wall of the slideway is of some thickness, it is possible to take advantage of this configuration to use curtains whose edges can be applied against said faces, or in which the ends of the stiffener bars can be provided with slide or guide members that are applied against said faces.

Figure 9:
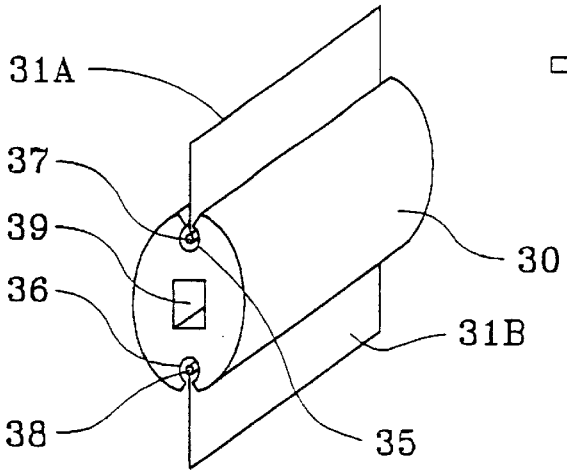
FIG. 9 is a perspective view of the end of a stiffener bar of a curtain, with fragments of curtain on either side.
Figure 10:
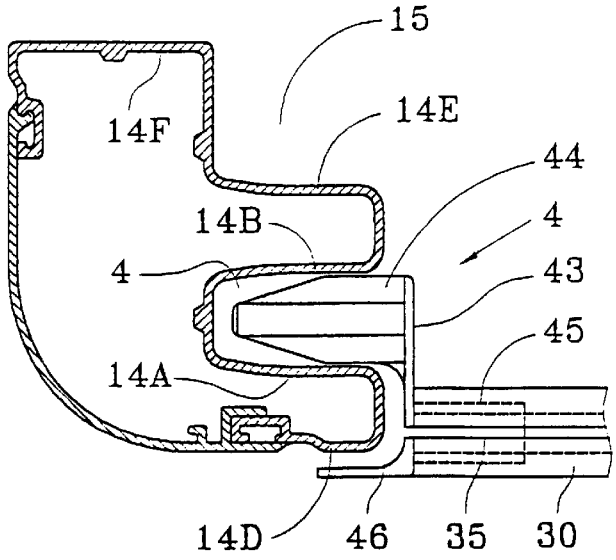
FIG. 10 is a plan view of the end of a curtain stiffener bar, as equipped with a guide shoe suitable for sliding in the slideway of the invention.
Figure 12:
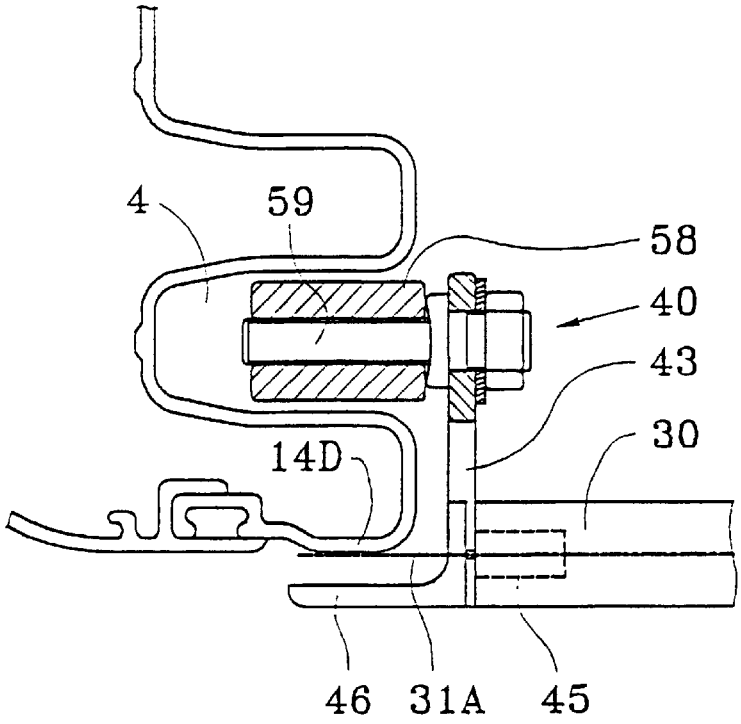
FIG. 12 is a section view on a horizontal plane of an edge of a door, above a stiffener bar, with a cutaway portion.
Figure 13:
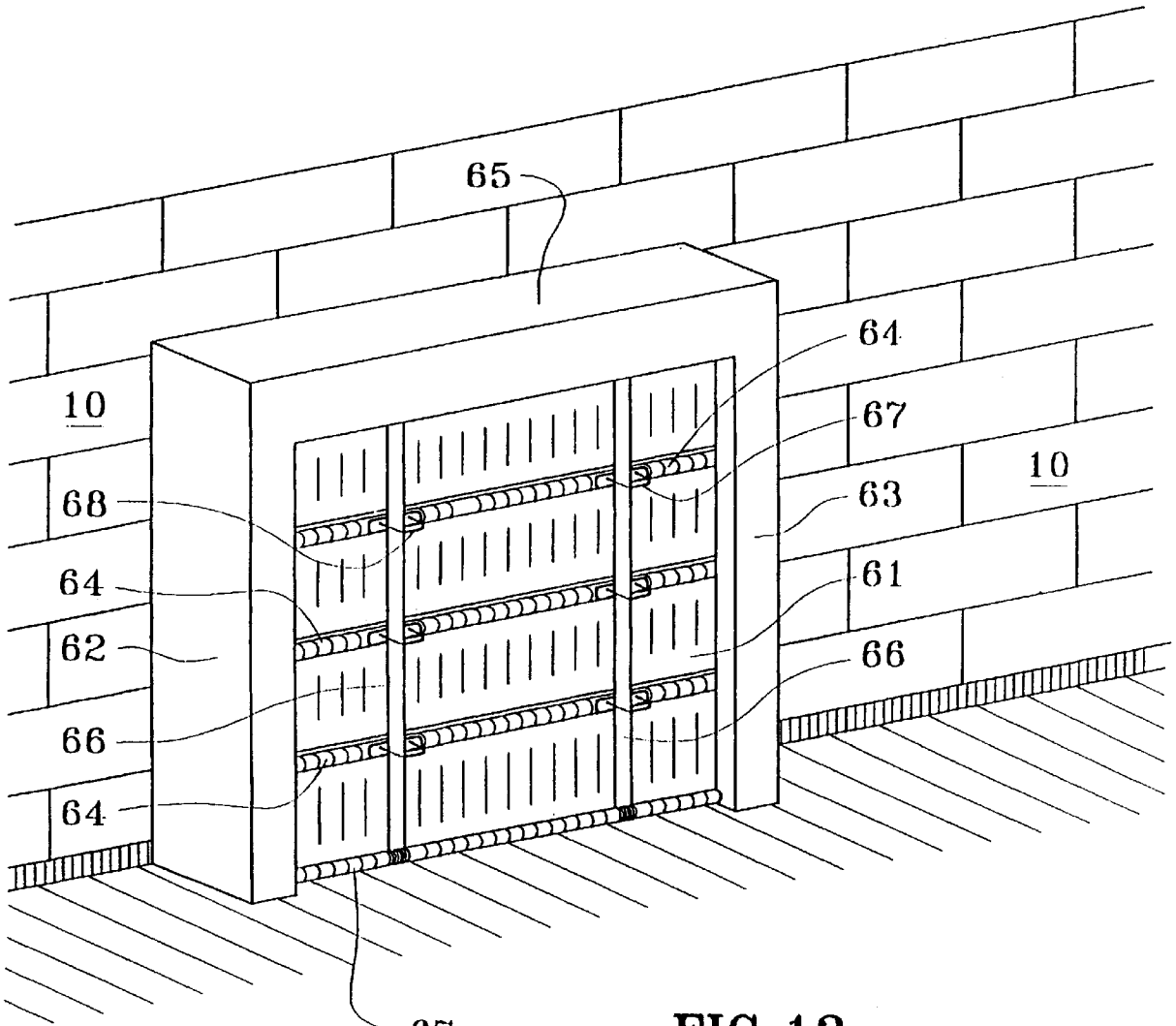
FIG. 13 is a perspective view of a conventional goods-handling door.

An embodiment of a door is shown in fragmentary manner in FIGS. 9, 10, and 12. FIG. 9 is a perspective view of a curtain in the vicinity of the end of a stiffener bar.

The bar 30 is a shaped-section member made of plastic, and remarkable in that it has two channels 35, 36 that are open to the outside via respective narrowed slots whose respective edges turn in towards each other, the channels being organized to receive and retain thickened edges 37, 38 of strips 31A, 31B of the curtain. In this example, the curtain may be made up of a plurality of strips of flexible sheet 31A, 31B disposed horizontally and joined together via stiffener bars. On the horizontal edges, the strips have extra thickness 37, 38. This may be obtained by means of a rod surrounded by the folded-over edge of the strip. It is thus possible to engage an edge of a strip in a channel 35 or 36 of a stiffener bar. The edge cannot be disengaged if a traction force is exerted on the strip in a direction perpendicular to the bar.

To guide the curtain, slide shoes 40 suitable for being received in the slideway of the invention are fixed to the ends of the bars. The shoe comprise four functional portions: a base portion 43 (FIGS. 10 and 12) that carries the three other portions; a guide peg 44, 58 organized to penetrate into and slide in the slideway 4; a bar support end-piece 45 shown in dashed lines, for receiving a bar which is provided with a cavity 39 in each of its end faces (FIG. 9) for receiving said end-piece; and a slide tab 46 which, by co-operating with the peg 44 and by sliding against the outside face 14D of the wall 4A of the slideway, guides the bar 30 and the edge of the curtain 1 accurately (see FIG. 12). Optionally, the base portion 13 of the guide shoe may be reinforced, e.g. by one or more angle brackets.

Advantageously, the wall 4A of the slideway is of thickness such that the outside face 14D of the wall lies substantially in the plane 16 of the curtain. This is obtained by offsetting the plane of the curtain horizontally relative to the axis of the slideway. Thus, as shown in FIGS. 10 and 12, the curtain-receiving channel 35 is substantially in alignment with the outside face 14D of the slideway. When his configuration is used, the edge of the curtain 31A (FIG. 12) can then extend beyond the end of the bar, and, when the curtain is under tension, i.e. in the low position, can come into place against said surface 14D, thereby providing good sealing for the door. The base portion 43 of the slide shoe can be placed heightwise between the backs of the channels 35, 36, or else it may be formed with two notches for receiving the thickened edges of the strips of curtain that project beyond the ends of the bars. The bottom edge of the strip 31A can thus be engaged in a channel formed in the slide tab 46.

Figure 11:
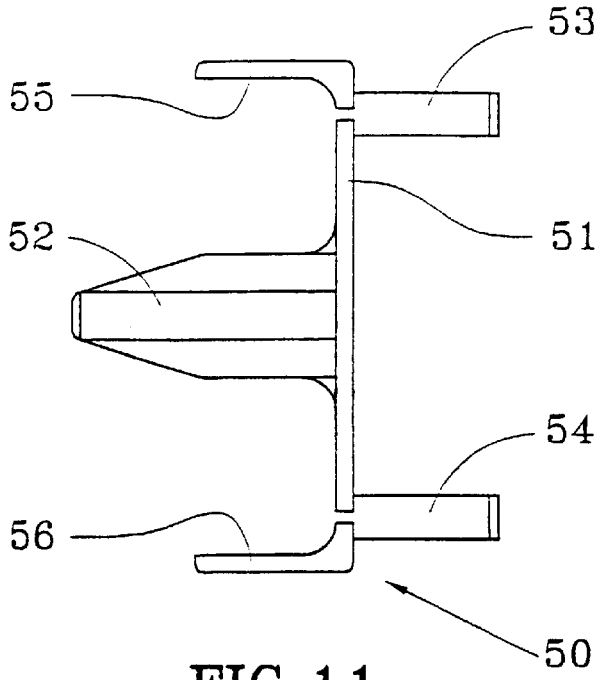
FIG. 11 is a plan view of a variant of a guide shoe.

As shown in FIG. 10, the curtain is placed on the same side as the outside face 14D of the slideway, away from the wall. However, with the configuration of the present invention, the curtain may be placed on the other side of the slideway, against the outside face 14E of the slideway that is adjacent to the plane face 14F of the upright, placed against the wall, because a space 15 that is large enough to receive the curtain is retained between the outside face 14E and the wall 10. FIG. 11 is a plan view of a guide shoe 150 that offers the possibility of placing two curtains in the same uprights with the same slideways. This shoe includes a base portion 51, a guide peg 52, two bar support end-pieces 53 and 54 and two slide tabs 55 and 56. Advantageously, it may be made with a horizontal plane of symmetry, thereby simplifying door installation.

It is thus possible to use a shoe suitable for receiving two bars, with a double-thickness or "double-skin" curtain. In a manner known per se, the raising straps may be disposed between the two skins.

FIG. 12 shows a variant of the slide shoe in which the guide peg is constituted by a roller 58 mounted to rotate on a pin 59 fixed to the base portion of the shoe. The roller can thus roll against either one of the inside faces 14, 14B of the slideway 4. This reduces wear and noise. The roller can be replaced easily.

What is claimed is:

1. A goods-handling door, comprising: two vertical uprights, and a flexible panel mounted to move up and down between the two uprights, each upright comprising:

an outwardly extending slideway for guiding one edge of the panel, the slideway being made up of two walls, each wall having an outside face and an inside face, the two inside faces defining a slide volume between them that is centered on a slide plane; each upright including a surface (14F) applied against a wall so that the slide plane is parallel to said wall, and so that said wall is situated at a sufficient distance (d) from the adjacent outside face (14E) of the slideway wall that is nearest said surface, and the volume situated between the wall and said adjacent outside face (14E) being unobstructed so as to be capable of receiving the edge of the panel when said panel is disengaged from the slideway; and wherein the panel is made up of at least one flexible curtain reinforced by at least one horizontal bar, said goods-handling door being characterized in that at least one wall (4A) of the slideway has a thickness such that the outside face (14D) of said wall lies substantially in a plane of the flexible curtain; and wherein the goods-handling door further comprises a slide shoe with a guide shoe (50) including a guide peg configured to penetrate into and slide in the slideway (4), and at least one slide tab (46, 55, 56) disposed to slide against the outside surface (14D, 14E) of a wall of the slideway.

2. The goods-handling door according to claim 1, characterized in that each upright has a closed section defining an internal volume that can receive accessories, a counterweight (3), controls, and ducts.

3. The goods-handling door according to claim 1, characterized in that each upright is obtained in a single operation.

4. The goods-handling door according to claim 3, characterized in that each upright is obtained by extrusion, pultrusion, drawing, rolling, thermoforming, continuous forming, or stamping.

5. The goods-handling door according to claim 1, characterized in that each upright is obtained by assembling together or snap-fastening at least two pieces, at least one of which is obtained in a single operation.

6. The goods-handling door according to claim 5, characterized in that for each upright at least one of the pieces is obtained by extrusion, pultrusion, drawing, rolling, thermoforming, continuous forming, or stamping.

7. The goods-handling door according to claim 1, characterized in that for each upright, in horizontal section, the slideway-forming piece is in the shape of two juxtaposed Us whose adjacent branches are interconnected at their tops via a web, so that said branches are spaced apart by the width required for guiding the edge of the curtain.

8. The goods-handling door according to claim 1, characterized in that each upright includes a base (11) for receiving the upright directly, which base bears against the floor.

9. The goods-handling door according to claim 1, characterized in that the panel comprises at least one curtain made up of at least two juxtaposed flexible sheets (61A, 61B) interconnected vertically via a stiffener bar, at least one edge of each sheet forming a horizontal portion of extra thickness (37, 38), and the bar being provided with two channels (35, 36) which open to the outside via a slot whose edges turn inwards to retain the thickened edges (37, 38) of the sheets.

10. The goods-handling door according to claim 1, characterized in that the guide peg is provided with a roller.

11. A vertically moveable door assembly mounted to a support surface located in a vertical mounting plane, comprising:

a door panel;

a first upright, comprising a first wall having a first outside face and a first inside face, the first wall extending in a first direction;

second wall having a second outside face and a second inside face, the second wall extending in the first direction and spaced apart from the first wall so as to define between the first inside face and the second inside face a guide groove extending along a longitudinal length of the upright, wherein the guide groove opens in the first direction away from the upright;

a mounting surface configured to mount the vertically moveable door assembly to the support surface, the mounting surface located in the mounting plane substantially parallel to the second outside face and offset from the second outside face by a distance d so as to define a free space between the vertical mounting plane and the second outside face;

wherein a lateral side edge of the door panel is engaged in or coupled to the guide groove, such that the door moves vertically up and down guided by the guided groove;

wherein the lateral side edge of the door further comprises a guide peg engaged in the guide groove; and wherein the guide peg offsets a main exposed front face of the door from the guide groove in a direction perpendicular to the first direction and towards the first outside face.

12. The vertically moveable door assembly according to claim 11, wherein the door is flexible, so that, when a force is incident on the door, the lateral side edge of the door is disengaged or de-coupled from the guide groove and received within the free space.

* * * * *